US011073345B2

(12) United States Patent
Dziubinschi et al.

(10) Patent No.: US 11,073,345 B2
(45) Date of Patent: Jul. 27, 2021

(54) HEAT EXCHANGER HEADER WITH STIFFENING ELEMENT

(71) Applicant: Hanon Systems, Daejeon (KR)

(72) Inventors: Orest Alexandru Dziubinschi, Dearborn, MI (US); Kyle Hanson, Northville, MI (US); Brennan Sicks, Farmington Hills, MI (US); Durai Duraiswamy, Canton, MI (US)

(73) Assignee: HANON SYSTEMS, Daejeon (KR)

( * ) Notice: Subject to any disclaimer, the term of this patent is extended or adjusted under 35 U.S.C. 154(b) by 80 days.

(21) Appl. No.: 16/176,040

(22) Filed: Oct. 31, 2018

(65) Prior Publication Data

US 2020/0132399 A1 Apr. 30, 2020

(51) Int. Cl.

| | |
|---|---|
| ***F28F 9/00*** | (2006.01) |
| ***F28F 19/00*** | (2006.01) |
| ***F28F 9/02*** | (2006.01) |

(52) U.S. Cl.

CPC ..... *F28F 19/00* (2013.01); *F28F 9/0226* (2013.01); *F28F 2009/0297* (2013.01); *F28F 2225/08* (2013.01)

(58) Field of Classification Search

CPC .. F28F 19/00; F28F 9/0226; F28F 2009/0297; F28F 2225/08; F28F 9/02; F28F 9/0229; F28F 9/0224; F28F 2275/122; F28D 1/05333; F28D 1/05366; F28D 1/053

See application file for complete search history.

(56) References Cited

U.S. PATENT DOCUMENTS

| | | | | |
|---|---|---|---|---|
| 4,324,290 | A * | 4/1982 | Moranne | F28D 1/0535 165/149 |
| 4,582,127 | A | 4/1986 | Moranne | |
| 4,651,821 | A | 3/1987 | Moranne | |
| 5,251,374 | A | 10/1993 | Halstead et al. | |
| 5,758,721 | A | 6/1998 | Letrange et al. | |
| 6,296,051 | B1 | 10/2001 | Sahnoun et al. | |
| 6,644,392 | B2 | 11/2003 | Kalbascher | |
| 7,210,520 | B2 | 5/2007 | Yamanaka et al. | |
| 7,341,098 | B2 | 3/2008 | Brost et al. | |
| 7,775,266 | B2 | 8/2010 | Freitag et al. | |
| 8,656,988 | B1 | 2/2014 | Paul et al. | |
| 9,739,541 | B2 | 8/2017 | Frankiewiez et al. | |
| 10,030,918 | B2 | 7/2018 | McWain | |
| 2002/0023734 | A1 | 2/2002 | Wagner | |

(Continued)

FOREIGN PATENT DOCUMENTS

| | | | |
|---|---|---|---|
| DE | 19857435 A1 | 6/1996 | |
| DE | 19857435 A1 * | 6/1999 | F28F 9/0224 |

(Continued)

*Primary Examiner* — Harry E Arant

(74) *Attorney, Agent, or Firm* — Shumaker, Loop & Kendrick, LLP; James D. Miller

(57) ABSTRACT

A header tank for a heat exchanger comprises a casing having a hollow interior and a header assembly coupled to the casing. The header assembly comprises a header having a plurality of tube openings formed therein and a stiffening element coupled to the header. The stiffening element includes a stiffening wall extending from a first longitudinal side of the header to an opposing second longitudinal side of the header to provide additional bending stiffness to the header assembly.

20 Claims, 7 Drawing Sheets

(56) References Cited

U.S. PATENT DOCUMENTS

| | | | | |
|---|---|---|---|---|
| 2008/0000627 | A1 | 1/2008 | Noguchi et al. | |
| 2010/0300664 | A1 | 12/2010 | Kang et al. | |
| 2017/0045305 | A1 | 2/2017 | Contet et al. | |
| 2017/0131043 | A1 * | 5/2017 | Contet | F28F 9/0224 |

FOREIGN PATENT DOCUMENTS

| | | | | |
|---|---|---|---|---|
| DE | 10057190 | A1 | | 5/2002 |
| DE | 202014103206 | U1 | | 10/2015 |
| EP | 0246779 | A1 | | 11/1987 |
| EP | 0453738 | A1 | | 10/1991 |
| EP | 0479012 | A1 | | 4/1992 |
| EP | 0735337 | A | | 10/1996 |
| EP | 2489974 | A1 | | 8/2012 |
| FR | 2525337 | A1 | | 10/1983 |
| FR | 2742528 | A1 | | 6/1997 |
| FR | 2770632 | A1 | | 5/1999 |
| FR | 2794227 | A1 | | 12/2000 |
| FR | 3020671 | A1 | | 11/2015 |
| FR | 3026169 | A1 | | 3/2016 |
| GB | 574450 | A | | 1/1946 |
| GB | 622421 | A | | 5/1949 |
| GB | 731431 | A | | 6/1955 |
| GB | 790704 | A | | 2/1958 |
| GB | 1485287 | A | | 9/1977 |
| JP | H0579280 | A | | 3/1993 |
| JP | H0618188 | A | | 1/1994 |
| JP | H09126681 | A | | 5/1997 |
| JP | H11118387 | A | | 4/1999 |
| JP | 2000039288 | A | | 2/2000 |
| JP | 2006162194 | A | | 6/2006 |
| JP | 2007078214 | A | | 3/2007 |
| JP | 4481426 | B2 | | 6/2010 |
| JP | 5185655 | B2 | * | 4/2013 |
| JP | 5185655 | B2 | | 4/2013 |
| KR | 100189826 | B1 | | 6/1999 |
| KR | 20040013873 | A | | 2/2004 |
| KR | 20060082557 | A | | 7/2006 |
| KR | 20060117579 | A | | 11/2006 |
| KR | 100737142 | B1 | | 7/2007 |
| KR | 101291032 | B1 | | 8/2013 |
| KR | 101291032 | B1 | * | 8/2013 | F28F 9/0278 |
| KR | 101396424 | B1 | | 5/2014 |
| KR | 20150070772 | A | | 6/2015 |
| KR | 20180023184 | A | | 3/2018 |
| KR | 101833366 | B1 | | 4/2018 |
| KR | 101844296 | B1 | | 4/2018 |
| KR | 20180046510 | A | | 5/2018 |
| WO | 2018020132 | A1 | | 2/2018 |

* cited by examiner

HEAT EXCHANGER HEADER WITH STIFFENING ELEMENT

FIELD OF THE INVENTION

The invention relates to a heat exchanger, and more specifically to a stiffening element configured for increasing a bending stiffness of a header tank of the heat exchanger.

BACKGROUND OF THE INVENTION

Heat exchangers typically include a centralized plurality of heat exchanger tubes or passageways connected at each respective end thereof to one of an inlet tank and an outlet tank. The plurality of heat exchanger tubes forms a heat exchanger core of the heat exchanger for transferring heat energy between two different heat exchanging fluids. The inlet tank and the outlet tank each typically include a surface that acts as a header having tube openings for receiving end portions of the heat exchanger tubes therein. The header of each of the tanks is then coupled to a casing of the tanks that aids in distributing or collecting a fluid flowing through the heat exchanger tubes.

It is not uncommon for slight temperature variations to exist at different regions within the heat exchanger core as a result of the form and configuration of various components of the heat exchanger such as the tanks, the headers, and the heat exchanger tubes. For example, a first set of the heat exchanger tubes may generally be an elevated temperature when compared to a second set of the heat exchanger tubes. This may occur when there is an unequal distribution of a fluid to an interior of the heat exchanger tubes forming the first and second sets. These variations in temperature can result in the first and second sets of the heat exchanger tubes experiencing different degrees of thermal expansion in the longitudinal direction of each of the tubes. Because each of the tubes is coupled to each of the tanks at the opposing ends thereof, the difference in thermal expansion between the different sets of the tubes can lead to a bending moment forming in one or both of the opposing headers as different regions of the opposing headers are separated to varying degrees with respect to the longitudinal direction of the tubes.

The presence of a bending moment within one of the headers can lead to a bending or flexing of the header. This bending or flexing can lead to an increased stress at a junction of one of the tubes and a corresponding one of the headers. The increased stress can potentially lead to failure at this junction, thereby presenting the possibility of leakage of one of the heat exchanging fluids from the heat exchanger tube.

It would therefore be desirable to produce a heat exchanger having header tanks that resist a bending or flexing thereof in reaction to variations of thermal expansion within a heat exchanger core of the heat exchanger.

SUMMARY OF THE INVENTION

Compatible and attuned with the present invention, a stiffening element for a heat exchanger that reinforces a header of the heat exchanger for minimizing a flexing or bending of the header has been surprisingly discovered.

In an embodiment of the invention, a header tank for a heat exchanger comprises a casing having a hollow interior and a header assembly coupled to the casing. The header assembly comprises a header having a plurality of tube openings formed therein and a stiffening element coupled to the header. The stiffening element includes a stiffening wall extending from a first longitudinal side of the header to an opposing second longitudinal side of the header.

In another embodiment of the invention, a heat exchanger comprises a first header tank including a first casing having a hollow interior and a first header assembly coupled to the first casing. The first header assembly comprises a first header having a plurality of first tube openings formed therein and a first stiffening element coupled to the first header. The first stiffening element includes a first stiffening wall extending from a first longitudinal side of the first header to an opposing second longitudinal side of the first header. A second header tank is arranged opposite the first header tank. A plurality of heat exchanger tubes extends longitudinally between the first header tank and the second header tank with one of the heat exchanger tubes received in each of the first tube openings formed in the first header of the first header tank.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
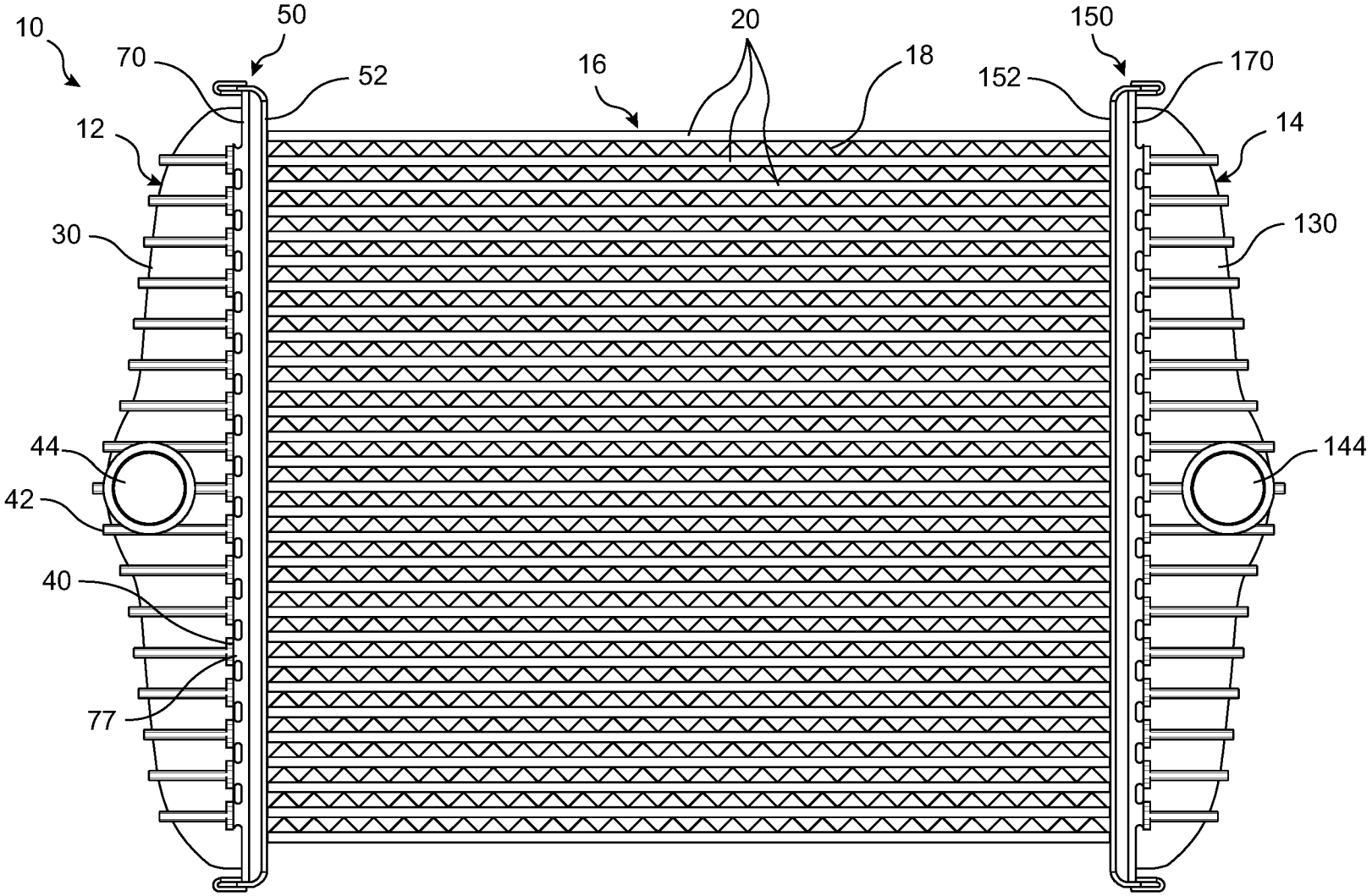
FIG. 1 is a side elevational view of a heat exchanger according to an embodiment of the present invention.

FIG. 1 illustrates a heat exchanger 10 according to an embodiment of the invention. The heat exchanger 10 may be used for any heat exchanging application such as forming an evaporator or a condenser of an air conditioning system, a radiator of a cooling system, or a charge air-cooler of a turbocharger system, as non-limiting examples. The heat exchanger 10 may be configured to pass any type of fluid therethrough, including a refrigerant or a coolant, as non-limiting examples. The fluid passed by the heat exchanger 10 may be configured for exchanging heat energy with a flow of air passing through the heat exchanger 10 in a direction arranged substantially perpendicular to a plane generally defined by the heat exchanger 10, but any form of secondary heat exchanging fluid may be used without departing from the scope of the present invention.

The heat exchanger 10 includes a first header tank 12, an oppositely arranged second header tank 14, and a heat exchanger core 16 extending between the first header tank 12 and the second header tank 14. The heat exchanger core 16 is formed by a plurality of spaced apart and parallel heat exchanger tubes 20. The heat exchanger tubes 20 may be any form of heat exchanger tubes, including extruded tubes or folded flat tubes, as non-limiting examples. The heat exchanger core 16 may further include surface area increasing features 18, such as corrugated fins, disposed between adjacent ones of the heat exchanger tubes 20 in order to increase a heat exchange capacity of the heat exchanger 10.

Figure 2:
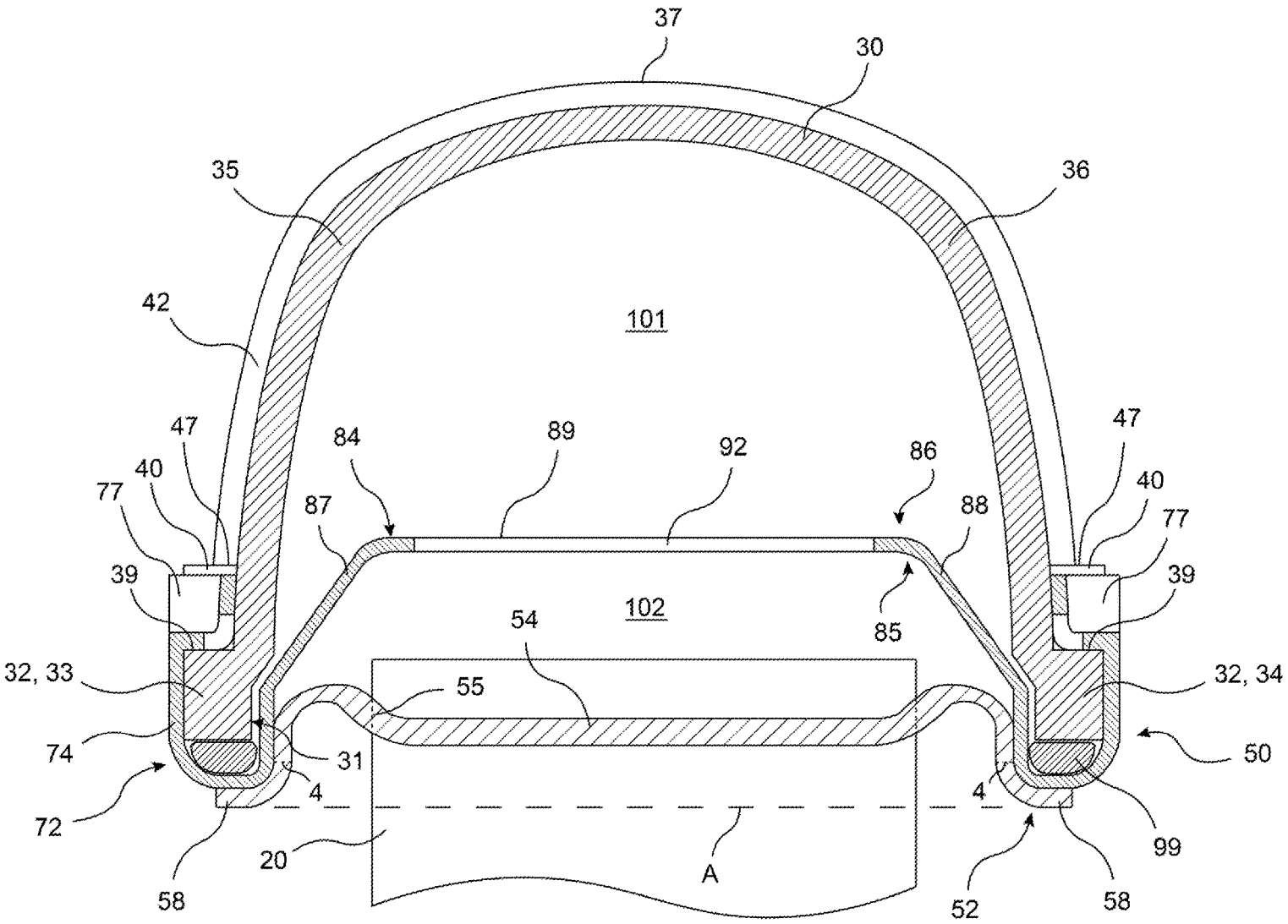
FIG. 2 is an enlarged fragmentary cross-sectional view through a header tank of the heat exchanger of FIG. 1.

As best shown in FIG. 2, the first header tank 12 includes a hollow first casing 30 and a first header assembly 50. The first casing 30 defines a manifold for distributing or recombining a first fluid passing through each of the heat exchanger tubes 20. The first casing 30 includes a foot 32 extending around a perimeter of a header opening 31 of the first casing 30. The foot 32 generally forms an outwardly flanged portion of the first casing 30. The foot 32 may generally include a substantially rectangular cross-sectional shape as the foot 32 extends around the perimeter of the header opening 31. The foot 32 may also include a first foot segment 33 and an oppositely arranged second foot segment 34 meeting at each of two opposing ends of the first casing 30. Further, the first casing 30 may include a first wall segment 35 and an oppositely arranged second wall segment 36. The first wall segment 35 extends from the first foot segment 33 to a spine 37 of the first casing 30 while the second wall segment 36 extends from the second foot segment 34 to the spine 37. The first and second wall segments 35, 36 may each be substantially arcuate in shape to form a first casing 30 having a substantially semi-circular or semi-elliptical cross-sectional shape.

The first casing 30 may include a plurality of longitudinally spaced crimp structures 40 having a substantially semi-cylindrical shape. Each of the crimp structures 40 may be an integrally formed structure projecting from one of the foot segments 33, 34 and a corresponding one of the wall segments 35, 36. Each of the crimp structures 40 may include a substantially semi-circular cross-sectional shape for allowing a corresponding structure to be bent or deformed to match the semi-circular shape of each of the crimp structures 40. The first casing 30 may further include a plurality of spaced apart ribs 42 formed on an outer surface thereof with each of the ribs 42 extending from one of the crimp structures 40 disposed on the first foot segment 33 to an opposing one of the crimp structures 40 disposed on the second foot segment 34. The ribs 42 may be added to the first casing 30 in order to re-inforce the first casing 30 against deformation due to thermal expansion when receiving the first fluid at an elevated pressure therein and other stresses applied to the casing 30.

The first casing 30 includes a first fluid port 44 providing fluid communication between the hollow interior of the first casing 30 and the remainder of a fluid system conveying the first fluid therethrough. The first fluid port 44 may form an inlet or an outlet of the first casing 30 depending on a direction of flow of the first fluid through the heat exchanger 10, and especially in cases where the heat exchanger 10 is configured to be passable bi-directionally to accommodate multiple different modes of operation of the associated fluid system. The first fluid port 44 is shown as a cylindrical conduit intersecting the first casing 30 at a central region thereof with respect to a longitudinal direction of the first casing 30. However, it should be understood that the first fluid port 44 may be disposed at any location on the first casing 30, at any orientation relative to the first casing 30, and can have any shape without departing from the scope of the present invention, including being disposed at or adjacent either of the two longitudinal ends of the first casing 30.

The first casing 30 may be formed from a polymeric material such as a rigid plastic material suitable for withstanding the internal pressure of the first fluid when passing through the first casing 30. The first casing 30 may accordingly be formed in a suitable molding operation, as one non-limiting example. However, it is understood other materials can be used as desired without departing from the scope of the invention.

The first casing 30 may have structure differing from that disclosed herein without departing from the scope of the present invention. More specifically, the first casing 30 may have any suitable structure so long as the first casing 30 defines a hollow interior for passing the first fluid while also including a foot 32 or other structure defining a perimeter of a header opening 31 having a closed shape such as a rectangular, rounded rectangular, or elliptical perimeter shape, as non-limiting examples.

The first header assembly 50 is formed by a first header 52 rigidly and securely coupled to a first stiffening element 70. The first stiffening element 70 is configured to resist a bending of a portion of the first header 52 away from a plane generally defined by the first header 52 when the first header 52 is not subjected to the forces and internal pressures present during operation of the heat exchanger 10. More specifically, the first stiffening element 70 resists a bending of the first header 52 about an axis arranged from one longitudinal side to an opposing longitudinal side of the first header 52, such as may be present when differing degrees of thermal expansion occur between different sets of the heat exchanger tubes 20 forming the heat exchanger core 16 of the heat exchanger 10, as explained in greater detail hereinafter.

Figure 3:
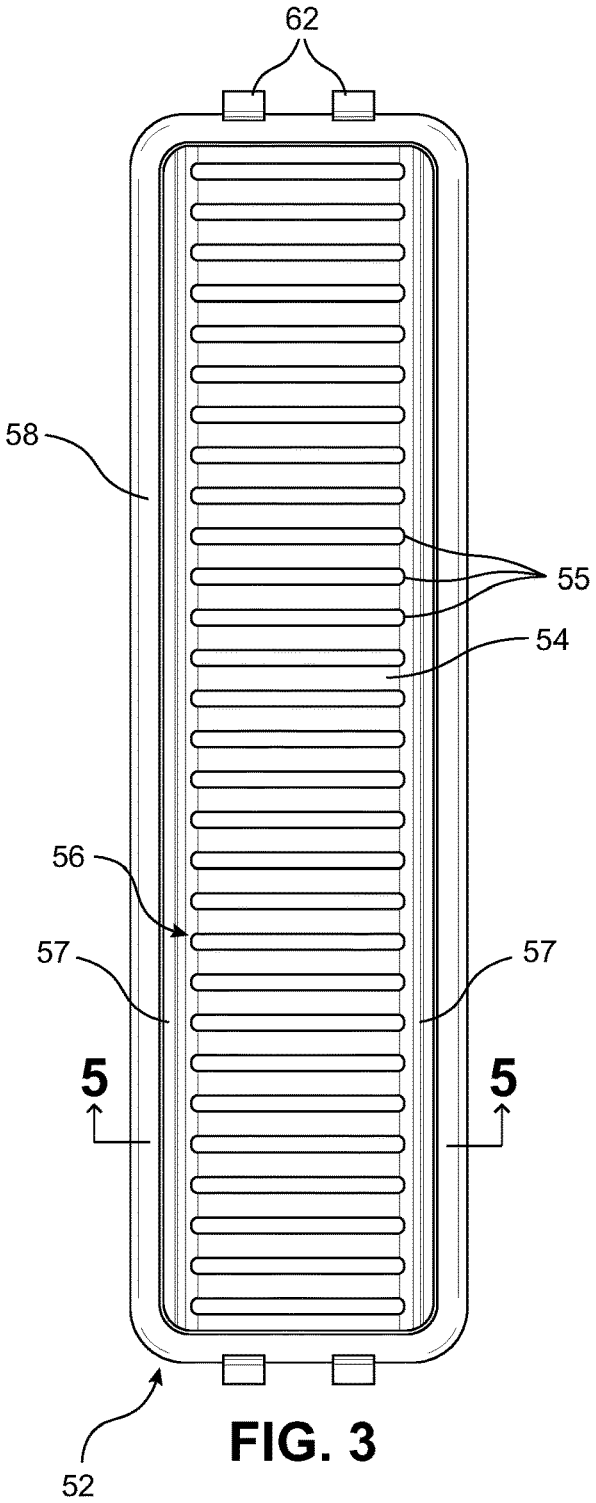
FIG. 3 is a front elevational view of a header of the heat exchanger of FIG. 1.
Figure 4:
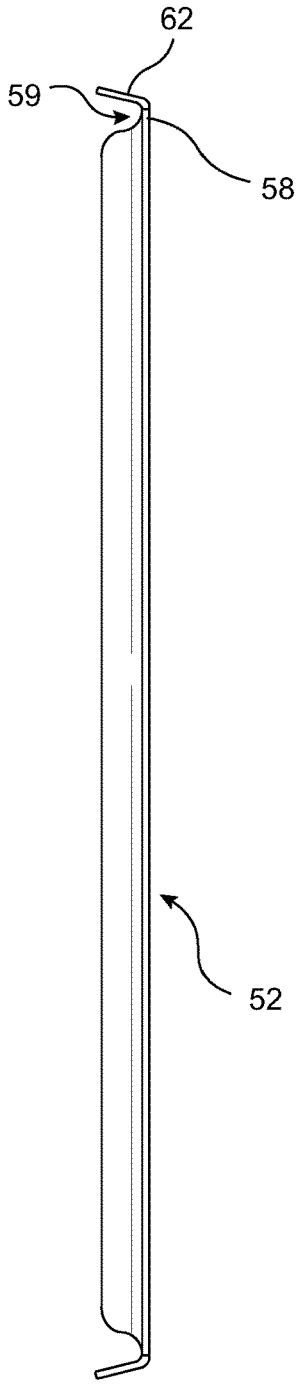
FIG. 4 is a side elevational view of the header.
Figure 5:
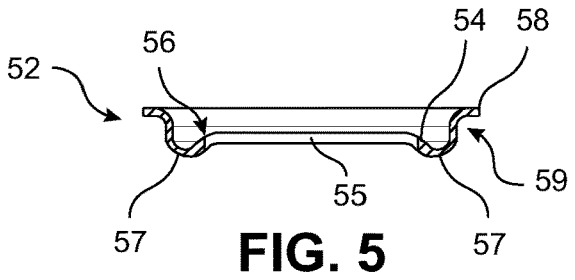
FIG. 5 is a cross-sectional view of the header taken along line 5-5 of FIG. 4.

The first header 52 of the first header assembly 50 is illustrated in isolation in FIGS. 3-5. The first header 52 includes a first header wall 54 having an outer surface configured to face towards the second header tank 14 when the heat exchanger 10 is fully assembled in the configuration illustrated in FIG. 1. The first header wall 54 includes a plurality of first tube openings 55 spaced apart from one another in a longitudinal direction of the first header 52. As shown in FIG. 5, a cross-sectional shape of the first header wall 54 may include a projecting portion 56 formed in a central portion of the first header wall 54 and projecting away from a plane of a pair of surrounding lateral portions 57 of the first header wall 54. The projecting portion 56 may extend in the longitudinal direction of the first header 52 across each of the first tube openings 55 in a manner wherein an angled portion of the projecting portion 56 partially defines a perimeter of each of the first tube openings 55. The projecting portion 56 may be included in the first header wall 54 in order to form a desired interaction between an outer surface of each of the heat exchanger tubes 20 and a surface of the first header 52 defining each of the first tube openings 55 for ensuring a desired joint therebetween. The first header 52 may alternatively be formed in the absence of the projecting portion 56, as desired.

The first header 52 further includes a coupling structure in the form of a peripheral rim 58 surrounding the first header wall 54 and defining a perimeter of the first header 52. The peripheral rim 58 may be formed to project both away from a plane of the first header wall 54 and radially outwardly in a manner forming a substantially concave surface 59 having an arcuate cross-sectional shape and extending around the perimeter of the first header 52. In other embodiments, the peripheral rim 58 may be devoid of an outwardly flared portion to cause the peripheral rim 58 to extend primarily in a direction perpendicular to the plane of the first header wall 54. For example, a dashed line 4 illustrated in FIG. 2 may represent a potential end point for the peripheral rim 58, thereby causing the entirety of the first header 52 to be substantially cup shaped and configured to nest within a portion of the first stiffening element 70. In either circumstance, the peripheral rim 58 is configured to form a coupling surface of the first header 52 suitable for coupling to a corresponding surface of the first stiffening element 70, as explained hereinafter. The peripheral rim 58 may have substantially the same perimeter shape as the foot 32 of the first casing 30, such as a rectangular, rounded-rectangular, or elliptical shape, as desired.

The peripheral rim 58 of the first header 52 may further include a pair of first coupling tabs 62 at each longitudinal end of the first header 52. Each of the first coupling tabs 62 is formed by a deformable projecting portion of the first header 52 configured for mating with a corresponding coupling structure of the first stiffening element 70, as explained in greater detail hereinafter.

The first header 52 may be formed from a metallic material such as aluminum. The aluminum may be formed to have a thickness providing a desired degree of compliancy to the first header 52, and specifically the first header wall 54, as desired. The first header 52 may be formed of other suitable materials having the desired strength and compliancy without necessarily departing from the scope of the present invention. The first header 52 may be at least partially coated with a suitable brazing material for initiating a brazing operation, as desired.

As best shown in FIGS. 6-9, which illustrate the first stiffening element 70 in isolation, the first stiffening element 70 includes a frame structure 72 and a stiffening wall 84. The frame structure 72 forms a coupling structure of the first stiffening element 70 configured for coupling to the peripheral rim 58 of the first header 52. The frame structure 72 extends around a perimeter of the first stiffening element 70 and has a perimeter shape substantially corresponding to the perimeter shape of the foot 32 of the first casing 30. The frame structure 72 may accordingly have a rectangular, rounded-rectangular, or elliptical perimeter shape, as non-limiting examples.

The frame structure 72 is defined by a frame wall 74 formed into an arcuate cross-sectional shape extending around the periphery of the frame structure 72. The frame wall 74 may be substantially U-shaped in cross-section, for example. The U-shaped cross-sectional shape results in the frame wall 74 including a concave surface 75 and an oppositely arranged convex surface 76. The concave surface 75 of the frame wall 74 forms a trough configured to receive the foot 32 of the first casing 30 therein when coupling the first casing 30 to the first header assembly 50 while the convex surface 76 is configured to engage the peripheral rim 58 of the first header 52 about a perimeter thereof. As can be seen in FIG. 2, the concave surface 59 of the first header 52 may have a shape substantially corresponding to the shape of the convex surface 76 of the frame structure 72 in a manner wherein the first header 52 is received into the frame structure 72.

A laterally outward portion of the frame wall 74 extending along each longitudinal side of the frame structure 72 may form a crimp strip 77 for crimping the first header assembly 50 to the first casing 30. The crimp strip 77 may form an outwardly extending tab having a plurality of longitudinally spaced apertures 78 formed therein. The apertures 78 may be added to the crimp strip 77 for rendering the crimp strip 77 more compliant when deforming the crimp strip 77 toward the foot 32 during a crimping process. Each of the portions of the crimp strip 77 disposed intermediate an adjacent pair of the apertures 78 may be deformed to substantially correspond to the semi-circular shape of each of the crimp structures 40 of the first casing 30 when crimping the first header assembly 50 to the first casing 30. Concurrently, each of the portions of the crimp strip 77 aligned with one of the apertures 78 thereof may be inwardly deformed to contact one of the wall segments 35, 36 of the first casing 30, thereby creating a corrugated profile of the crimp strip 77 forming an interference pattern with respect to the foot 32 of the first casing 30, thereby preventing removal of the first stiffening element 70 from the first casing 30. The crimp strip 77 may include an outwardly flared portion 79 to facilitate entry of the foot 32 of the first casing 30 therein.

The frame structure 72 may further include a pair of first coupling clips 82 at each longitudinal end thereof. Each of the first coupling clips 82 may be formed as a deformable strip of material bent to form a wedge shape between two legs of the strip of material. The wedge shape of each of the first coupling clips 82 may be configured to receive a portion of each of the first coupling tabs 62 of the first header 52 therein to further couple the first header 52 to the frame structure 72, wherein each of the first coupling clips 82 may be further deformed to maintain a position of each of the first coupling tabs 62 when received therein.

The stiffening wall 84 extends from one longitudinal side of the frame structure 72 to an opposing longitudinal side of the frame structure 72 while also extending in a longitudinal direction of the first stiffening element 70 with the opposing ends of the stiffening wall 84 spaced from each of the opposing ends of the frame structure 72. As best shown in FIG. 2, the stiffening wall 84 includes a substantially concave inner surface 85 facing towards the first tube openings 55 of the first header 52 and a substantially convex outer surface 86 facing towards an inner surface of the first casing 30 defining the hollow interior thereof. The concavity of the inner surface 85 results in the stiffening wall 84 generally extending away from the first header wall 54 with respect to the longitudinal direction of the heat exchanger tubes 20 as the stiffening wall 84 approaches a central portion thereof with respect to the lateral direction of the stiffening wall 84.

More specifically, the stiffening wall 84 is shown in FIG. 2 as including a first lateral portion 87, a second lateral portion 88, and a central portion 89. The first lateral portion 87 extends between a first longitudinal side of the frame structure 72 and the central portion 89, the second lateral portion 88 extends between a second longitudinal side of the frame structure 72 and the central portion 89, and the central portion 89 extends between the first lateral portion 87 and the second lateral portion 88. The first lateral portion 87 and the second lateral portion 88 may be arranged symmetrically relative to each other with each of the lateral portions 87, 88 arranged at an acute angle with respect to the first header wall 54 of the first header 52. The central portion 89 may be formed to extend substantially parallel to the plane of the first header wall 54 while spaced apart therefrom by a first distance with respect to the longitudinal direction of the heat exchanger tubes 20.

The stiffening wall 84 further includes a plurality of flow openings 92 formed therein. The flow openings 92 may be formed in any of the first lateral portion 87, the second lateral portion 88, or the central portion 89 of the stiffening wall 84. Each of the flow openings 92 provides fluid communication between a first chamber 101 formed by the cooperation of the first casing 30 and the convex outer surface 86 of the stiffening wall 84 and a second chamber 102 formed by the cooperation of the stiffening wall 84 and the first header 52. The first chamber 101 is in direct fluid communication with the first fluid port 44 while the second chamber 102 is in direct fluid communication with each of the heat exchanger tubes 20 extending through the first header wall 54.

Figure 6:
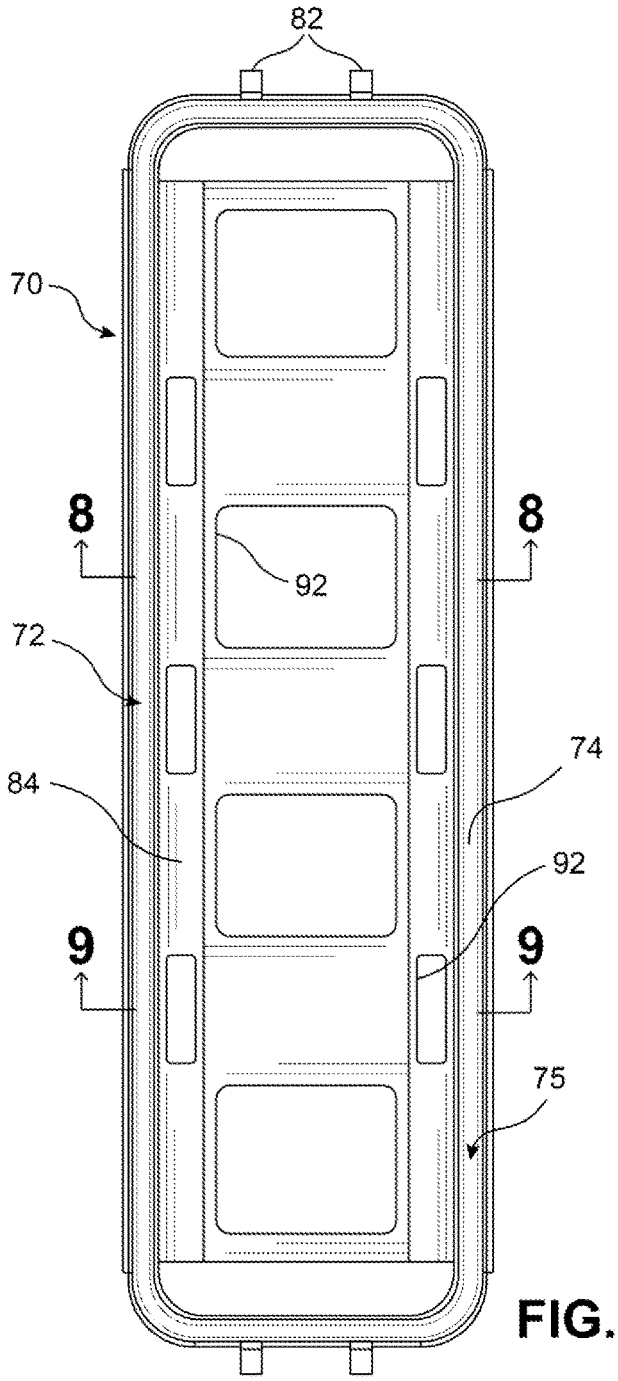
FIG. 6 is a front elevational view of a stiffening element of the heat exchanger of FIG. 1.
Figure 7:
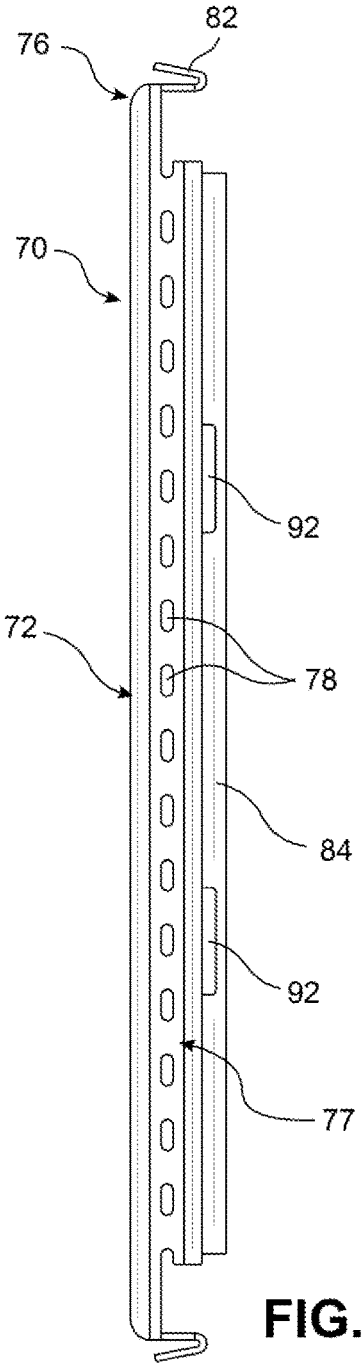
FIG. 7 is a side elevational view of the stiffening element.
Figure 8:
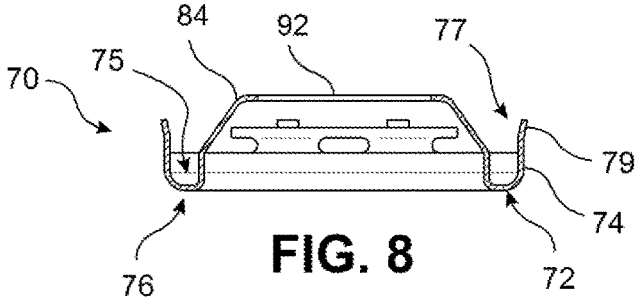
FIG. 8 is a cross-sectional view of the stiffening element taken along line 8-8 of FIG. 6.
Figure 9:
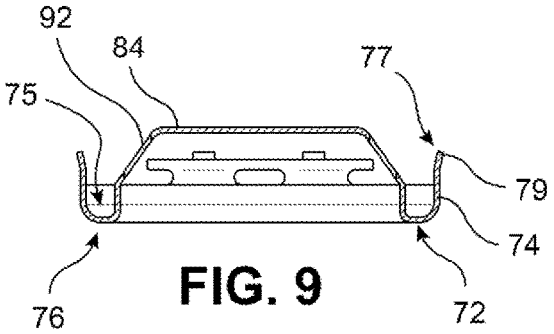
FIG. 9 is a cross-sectional view of the stiffening element taken along line 9-9 of FIG. 6.

As shown in FIG. 6, the flow openings 92 may be spaced from each other in a longitudinal direction of the stiffening wall 84 and hence the first header 52. In some embodiments, the flow openings 92 formed in the first and second lateral portions 87, 88 may be interposed at positions intermediate the flow openings 92 formed in the central portion 89, as shown herein. The flow openings 92 are shown as having a substantially rectangular or rounded-rectangular shape. However, alternative shapes or patterns of the flow openings 92 may be formed in the stiffening wall 84 without departing from the scope of the present invention, as desired. As mentioned previously, each of the longitudinal ends of the stiffening wall 84 may be spaced from each longitudinal end of the frame structure 72, thereby effectively providing an additional one of the flow openings 92 at each longitudinal end of the stiffening wall 84. The number of the flow openings 92 formed in the stiffening wall 84 may be fewer or greater than the number of the tube openings 55 of the first header 52 in order to facilitate a desired flow configuration through the first casing 30. For example, each of the flow opening 92 may correspond to a plurality of the tube openings 55, as desired.

The first stiffening element 70 is shown in FIG. 6 as including a single segment of the stiffening wall 84 extending between the longitudinal sides of the first stiffening element 70, but it should be understood that the first stiffening element 70 may instead be produced to include a plurality of longitudinally spaced segments of the stiffening wall 84, wherein each space between adjacent ones of the segments forms an additional flow opening 92 of the first stiffening element 70. The division of the stiffening wall 84 into a plurality of segments may allow for only specific portions of the first header 52 to be fully reinforced by the first stiffening element 70 in accordance with the expected bending configuration of the first header 52 during operation of the heat exchanger 10. The stiffening wall 84 may alternatively be formed as a single segment extending along only a minor portion of the length of the first stiffening element 70, such as a portion disposed adjacent one end thereof, as desired.

The first stiffening element 70 may be formed from a metallic material such as aluminum. If not formed from the same material as the first header 52, the first stiffening element 70 may instead be formed from a complimentary material configured for joining to the material forming the first header 52 during an aggressive joining method, such as brazing, welding, or soldering, as non-limiting examples. The first stiffening element 70 may accordingly be at least partially coated with a suitable brazing material for initiating a brazing operation, as desired.

As shown in FIG. 2, a peripheral seal 99 may be disposed within the trough formed by the concave surface of the frame wall 74 at a position intermediate the frame wall 74 and the foot 32 of the first casing 30 when the first header assembly 50 is coupled to the first casing 30. The peripheral seal 99 ensures that a fluid tight seal is present between the first header assembly 50 and the first casing 30 about a perimeter thereof in order to prevent the leakage of the first fluid from within the first header tank 12. The peripheral seal 99 may be formed from an elastomeric material, as desired.

The second header tank 14 may include substantially the same structure as the first header tank 12, including a second header assembly 150 formed by the cooperation of a second header 152 and a second stiffening element 170 and a second casing 130 forming a manifold for distributing or recombining the first fluid passed by the heat exchanger 10. The second casing 130 may include a second fluid port 144 forming an inlet or outlet into the second casing 130. As such, discussion of the specific structure of the second header tank 14 is omitted herein. Additionally, it should be understood that the heat exchanger 10 may be formed with only one of the header tanks 12, 14 thereof having the structure disclosed herein without necessarily departing from the scope of the present invention.

Figure 10:
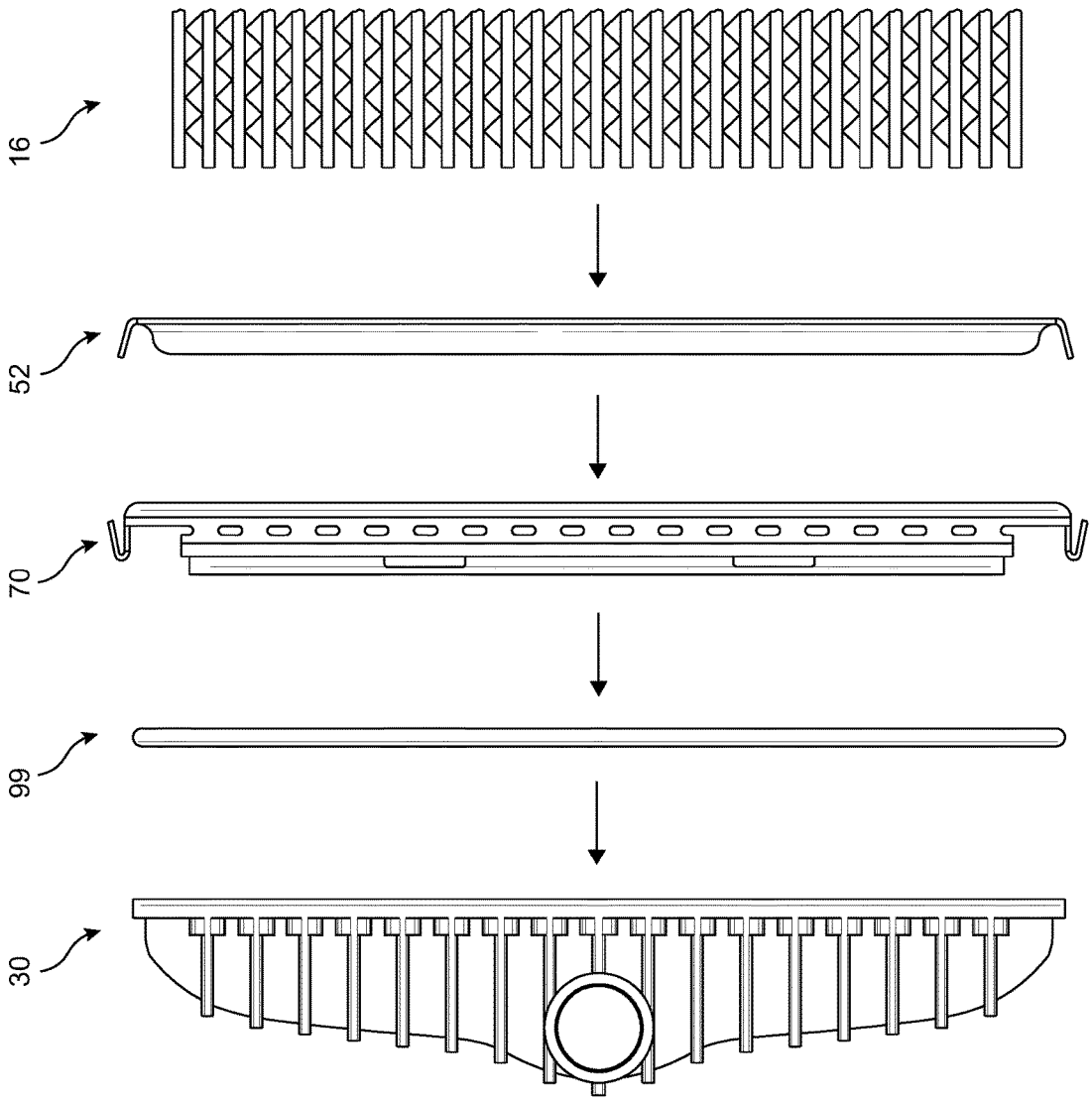
FIG. 10 is an exploded fragmentary side elevational view showing a method of assembly of the heat exchanger of FIG. 1.

With reference to FIG. 10, which illustrates each relevant component of the first header tank 12 and the heat exchanger core 16 in exploded form, a method of assembling the heat exchanger 10 may occur according to the following steps.

First, the first header 52 may be received in the frame structure 72 of the first stiffening element 70 by placing the concave surface 59 of the peripheral rim 58 of the first header 52 in abutment with the convex surface 86 of the frame wall 74 of the first stiffening element 70. Once properly aligned, each of the first coupling tabs 62 of the first header 52 may be deformed into a corresponding one of the first coupling clips 82 to form a mechanical connection between the first header 52 and the first stiffening element 70. The second header 152 and the second stiffening element 170 of the second header tank 14 may also be mechanically joined to each other in similar fashion to that described with reference to the first header tank 12 to form a second header assembly 150 opposite the first header assembly 50.

The heat exchanger tubes 20 may be simultaneously arranged in parallel and spaced apart from each other to receive the surface area increasing features 18 between adjacent ones of the heat exchanger tubes 20. Once properly aligned into the form of the heat exchanger core 16, the end portions of each of the heat exchanger tubes 20 are received into each of the corresponding tube openings 55 of each of the first header 52 and the second header 152.

The assembly process next includes the steps of securely coupling the first header 52 to the first stiffening element 70 to form a fluid-tight first header assembly 50, securely coupling the second header 152 to the second stiffening element 170 to form a fluid-tight second header assembly 150, securely coupling the first header 52 to an end portion of each of the heat exchanger tubes 20, and securely coupling the second header 152 to an opposing end portion of each of the heat exchanger tubes 20. Each of the aforementioned coupling steps may occur simultaneously or in any desired order. The secure couplings may be formed by any suitable aggressive joining method, including soldering, brazing, or welding, as desired. As explained throughout, one particularly suitable manufacturing method may include simultaneously joining each of the aforementioned components using a single brazing process when each of the components are properly arranged to allow a corresponding brazing material to flow into each desired joint, thereby eliminating additional manufacturing steps to simplify construction of the resulting heat exchanger 10.

The secure coupling of the first header 52 to the first stiffening element 70 includes the first header 52 securely coupled to the frame structure 72 of the first stiffening element 70 about an entirety of a perimeter of the peripheral rim 58 to avoid any potential fluid leaks from the resulting first header assembly 50. The second header 152 is similarly joined to the second stiffening element 170 about a perimeter thereof to prevent any leaks from the resulting second header tank 14.

The resulting assembly including the first header assembly 50, the heat exchanger core 16, and the second header assembly 150 is then ready to be coupled to each of the first header tank 12 and the second header tank 14. With specific reference to the first header tank 12, the foot 32 of the first casing 30 is received into the concave surface 75 formed by the frame wall 74 about a perimeter of the first header assembly 50 with the peripheral seal 99 disposed therebetween. The crimp strip 77 projecting from the frame wall 74 is then deformed inwardly to extend at least partially over a shoulder 39 of the foot 32 to couple the frame structure 72 of the first stiffening element 70 to the first casing 30 while compressing the peripheral seal 99 between the foot 32 and the frame wall 74 to fluidly seal the joint formed between the first casing 30 and the first header assembly 50. The second header tank 14 is joined to the second header assembly 150 using the same process as disclosed above with reference to the first header tank 12.

In use, the first fluid enters the first header tank 12 through the first fluid port 44 thereof. The first fluid then enters the first chamber 101 of the first header tank 12 formed on the convex side of the stiffening wall 84. The size, shape, and positioning of each of the flow opening 92 within the stiffening wall 84 determines a distribution of the first fluid when entering the second chamber 102, and hence a distribution of the first fluid to each of the heat exchanger tubes 20 in fluid communication with the second chamber 102 formed on the concave side of the stiffening wall 84. The first fluid is then able to traverse each of the heat exchanger tubes 20 before entering a corresponding second chamber (not shown) of the second header tank 14 disposed between the second header 152 and the second stiffening element 170. The first fluid is then able to flow from the second chamber and into a first chamber (not shown) disposed between the second stiffening element and a wall of the second casing 130 via a plurality of the openings formed in the second stiffening element. The first fluid then recombines within the second chamber before exiting the second casing 130 through the second fluid port 144 thereof.

The disclosed heat exchanger 10 advantageously prevents a failure of the first header 52 by preventing deformation of the first header 52 in response to an occurrence of unequal thermal expansion between different ones of the heat exchanger tubes 20 when traversed by the first fluid. More specifically, the addition of the first stiffening element 70 to the first header 52 when constructing the first header assembly 50 results in an area moment of inertia of the resulting first header assembly 50 that is greater than an area moment of inertia of the first header 52 in the absence of the first stiffening element 70. An area moment of inertia for a given cross-section describes a capacity for the given cross-section to resist bending with respect to a reference axis. The area moment of inertia for the given cross-section is increased when the area occupied by the cross-section in question is disposed at an increased distance from an associated reference axis. In the given circumstance, the reference axis may be an axis extending in the width or lateral direction of the first header 52 while arranged on a plane generally defined by the longitudinal direction and the width direction of the first header 52. The reference axis accordingly extends perpendicular to each of a longitudinal direction of each of the heat exchanger tubes 20 and the longitudinal direction of the first header 52.

FIG. 2 illustrates an exemplary reference axis A extending from a first side of the peripheral rim 58 of the first header 52 to an opposing second side of the peripheral rim 58. The manner in which the stiffening wall 84 projects away from the reference axis A with respect to the longitudinal direction of the tubes 20 positions a greater portion of the cross-section of the first header assembly 50 at a distance from the associated reference axis A. The first stiffening element 70 accordingly provides bending stiffness to the first header 52 when subjected to forces tending to bend the first header 52 about a corresponding reference axis extending in the width direction of the first header 52, such as when different portions of the first header 52 experience different forces in a direction parallel to the longitudinal direction of each of the heat exchanger tubes 20 as a result of unequal thermal expansion between different sets of the heat exchanger tubes 20.

The inclusion of a specified pattern of the flow openings 92 in the stiffening wall 84 also aids in preventing an incidence of unequal thermal expansion within the heat exchanger tubes 20 by distributing the first fluid to each of the heat exchanger tubes 20 in a prescribed manner. The flow openings 92 may be positioned to cause the first fluid to flow substantially evenly to each of the heat exchanger tubes 20 by controlling the flow area through each region of each of the header tanks 12, 14. Such a feature may be utilized to reduce an incidence of unequal flow rate of the first fluid or an unequal pressure drop of the first fluid when flowing through specific portions of each of the header tanks 12, 14.

The heat exchanger 10 having the first stiffening element 70 is further improved by allowing for the first header wall 54 of the first header 52 to be formed with a decreased thickness in comparison to the header of a similar heat exchanger devoid of the first stiffening element 70 due to the increased stiffness provided by the first stiffening element 70. The decreased thickness of the first header wall 54 allows for the first header wall 54 to be more compliant and flexible with respect to a localized area, which can aid in accommodating a deformation of the first header wall 54 or one of the heat exchanger tubes 20 at the localized area during operation of the heat exchanger 10. For example, one of the heat exchanger tubes 20 experiencing an elevated degree of thermal expansion in comparison to an adjacent one of the heat exchanger tubes 20 may allow for the first header wall 54 to deform slightly adjacent the corresponding tube opening 55 receiving the thermally elevated heat exchanger tube 20 to accommodate the deformation of the thermally elevated heat exchanger tube 20. However, the increased stiffness provided by the first stiffening element 70 prevents a major portion of the first header wall 54 from deviating from a plane generally defined by the first header wall 54, thereby preventing a failure at or adjacent the corresponding tube opening 55 despite the slight degree of localized deformation allowed by the compliancy of the first header wall 54 having the reduced thickness.

The stiffening wall 84 of the first stiffening element 70 is arranged to extend a desired distance from a plane generally defined by the width direction and the longitudinal direction of the first header wall 54 of the first header 52 in order to achieve a desired area moment of inertia of the stiffening wall 84 from the perspective of the cross-section of FIG. 2. The stiffening wall 84 may be formed wherein at least one portion of the stiffening wall 84 is disposed at a greater distance from the plane of the first header wall 54 with respect to the longitudinal direction of the heat exchanger tubes 20 than is the shoulder 39 of the foot 32 of the first casing 30 when the first header tank 12 is fully assembled. The at least one portion of the stiffening wall 84 may additionally be disposed further from the plane of the first header wall 54 than is a shoulder 47 of each of the crimp structures 40 disposed on and extending from the shoulder 39 of the foot 32. The at least one portion of the stiffening wall 84 may also be disposed further from the plane of the first header wall 54 than any portion of the remainder of the first header assembly 50, including the laterally disposed crimp strips 77 of the first stiffening element 70. The at least one portion of the stiffening wall 84 may typically be a central portion of the stiffening wall 84 due to the concavity of the inner surface 85 of the stiffening wall 84. In some embodiments, the at least one portion of the stiffening wall 84 may be disposed at least twice as far from the plane of the first header wall 54 than the shoulder 39 of the foot 32 with respect to the longitudinal direction of the heat exchanger tubes 20. The at least one portion of the stiffening wall 84 may alternatively be described as being disposed at a greater distance from a plane defined by the coupling engagement between the first header 52 and the frame structure 72 than each of the aforementioned features of the present invention. More specifically, the plane of coupling engagement may refer to the plane of the peripheral rim 58 at the point of engagement with a lowermost portion of the trough formed by the frame structure 72 of the first stiffening element 70.

The stiffening wall 84 is not limited to the substantially trapezoidal cross-sectional shape illustrated in FIG. 2. The stiffening wall 84 may include any cross-sectional shape so long as the inner surface 85 thereof is formed to be substantially concave with respect to the first header 52 in order for the stiffening wall 84 to project away from the plane of the first header wall 54 to provide the desired stiffness to the first header assembly 50 while enclosing the second chamber 102 of the first header tank 12. It should accordingly be understood that as used herein, the inner surface 85 of the stiffening wall 84 being described as substantially concave refers to the manner in which the inner surface 85 generally includes angles of less than 180 degrees between adjacent portions of the stiffening wall 84 to cause the resulting shape to arc from one longitudinal side of the first header 52 to the opposing longitudinal side thereof. Similarly, the outer surface 86 being described as substantially convex refers to the manner in which the outer surface 86 generally includes angles of greater than 180 degrees between adjacent portions of the stiffening wall 84. The stiffening wall 84 may accordingly be formed from any series of linearly extending or curved segments so long as the segments cooperate to project away from the plane of the first header 52 while connecting opposing longitudinal sides thereof.

Figure 11:
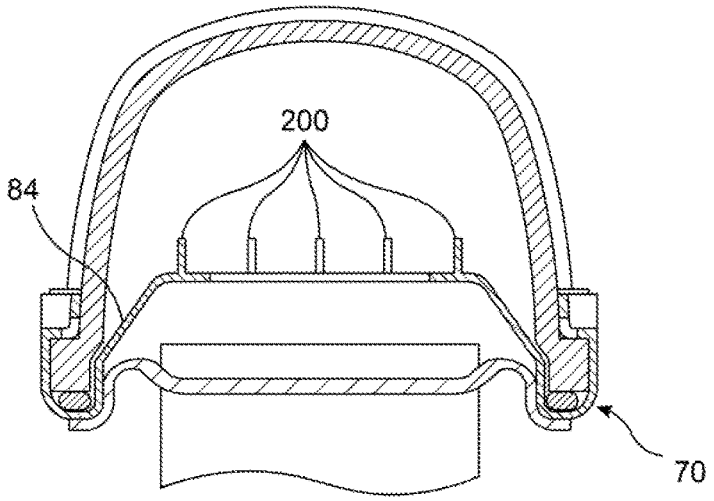
FIG. 11 is an enlarged fragmentary cross-sectional view of a stiffening element having a plurality of ribs according to another embodiment of the invention.
Figure 12:
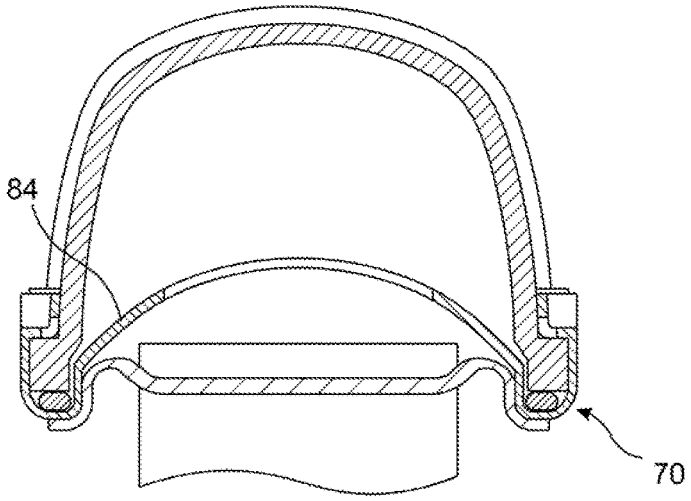
FIG. 12 is an enlarged fragmentary cross-sectional view of a stiffening element having an arcuate cross-sectional shape according to another embodiment of the invention.
Figure 13:
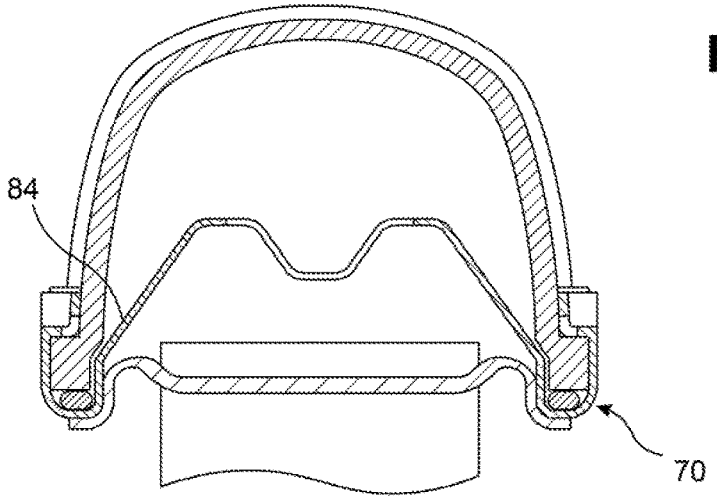
FIG. 13 is an enlarged fragmentary cross-sectional view of a stiffening element having a corrugated cross-sectional shape according to another embodiment of the invention.

For example, FIG. 11 illustrates an alternative embodiment of the stiffening wall 84 including a plurality of longitudinally extending ribs 200 providing additional bending stiffness to the first header assembly 50 by further increasing the area moment of inertia of the stiffening wall 84. FIG. 12 also illustrates an alternative embodiment of the stiffening wall 84 wherein the trapezoidal shape of the stiffening wall 84 as disclosed in FIG. 2 is replaced with an arcuate cross-sectional shape extending to the desired distance from the plane of the first header wall 54 with respect to the longitudinal direction of the heat exchanger tubes 20. FIG. 13 illustrates an alternative embodiment of the stiffening wall 84 wherein the stiffening wall 84 includes a substantially corrugated profile while still maintaining the same general concavity with respect to the first header 52 due to the manner in which the stiffening wall 84 primarily projects away from the first header 52. The corrugations may further aid in strengthening the stiffening wall 84 from bending with respect to the prescribed reference axis. One skilled in the art should appreciate that alternative shapes for the stiffening wall 84 may be used without departing from the scope of the present invention while maintaining the relationships disclosed herein.

Figure 14:
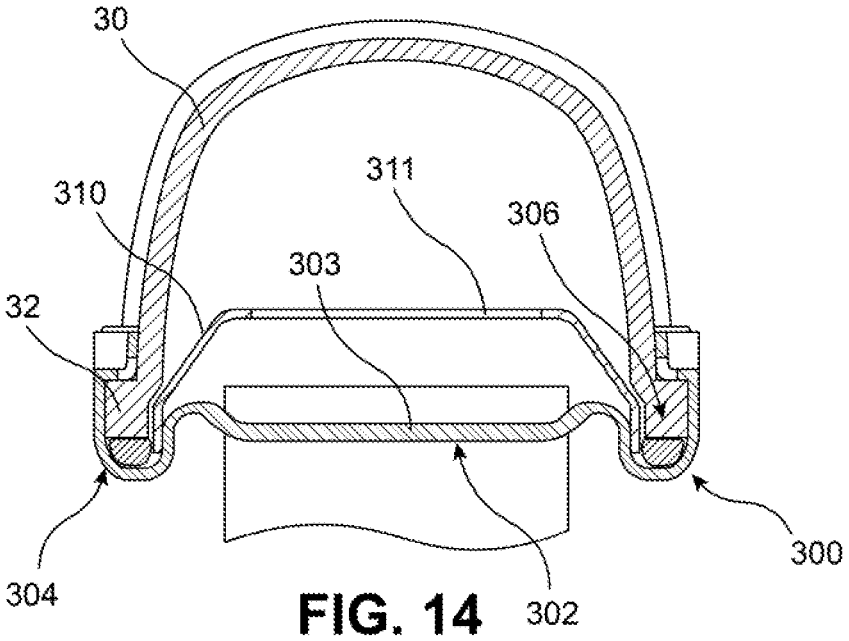
FIG. 14 is an enlarged fragmentary cross-sectional view of a header assembly having a modified header and stiffening element according to another embodiment of the invention.

It should also be understood that the benefits of the disclosed first stiffening element 70 may also be utilized while substantially reversing the configuration of the first header 52 and the first stiffening element 70 with respect to a method of coupling the resulting header assembly to the first casing 30. For example, FIG. 14 illustrates a header assembly 300 including a header 302 having an outwardly flanged coupling portion 304 surrounding a header wall 303 thereof having a plurality of tube openings (not shown) formed therein. The coupling portion 304 includes a trough 306 configured to receive the foot 32 of the first casing 30 therein. A stiffening element of the header assembly 300 is formed by a stiffening wall 310 extending from one longitudinal side of the header wall 303 to an opposing longitudinal side of the header 303 while maintaining the general configuration of the stiffening wall 84 as disclosed in FIG. 2, including at least one opening 311 for passing a fluid through the stiffening wall 310. The coupling of the header 302 to the first casing 30 may allow for the stiffening wall 310 to be coupled to the header 302 along only two longitudinally extending segments thereof as opposed to an entirety of a perimeter thereof due to the lack of a need for a fluid tight seal at the intersection of the header 302 and the stiffening wall 310. The resulting header assembly 300 otherwise operates in substantially the same manner as described with reference to the first header assembly 50, as desired.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A header tank for a heat exchanger comprising:

a casing having a hollow interior; and a header assembly coupled to the casing, the header assembly further comprising:

a header having a plurality of tube openings formed therein with each of the tube openings disposed on a first plane of the header; and a stiffening element coupled to the header, the stiffening element including a stiffening wall extending from a first longitudinal side of the header to an opposing second longitudinal side of the header, wherein the casing includes an outwardly flanged foot extending around a perimeter of a header opening formed in the casing and a crimp structure disposed on and projecting away from a surface of the foot arranged parallel to the first plane of the header, the crimp structure having a shoulder spaced from the surface of the foot, wherein the stiffening wall extends from a frame structure of the stiffening element, the frame structure coupled to each of the casing and the header, and wherein at least a portion of the stiffening wall is spaced further from the first plane of the header than the shoulder of the crimp structure with respect to a first direction arranged perpendicular to the first plane of the header.

2. The header tank of claim 1, wherein a concave inner surface of the stiffening wall faces towards the header and an oppositely arranged and convex outer surface of the stiffening wall faces towards an inner surface of the casing defining the hollow interior thereof.

3. The header tank of claim 2, wherein the stiffening wall includes a central portion arranged parallel to the header, a first lateral portion angled with respect to the central portion, and a second lateral portion angled with respect to the central portion.

4. The header tank of claim 2, wherein the stiffening wall is arcuate in shape.

5. The header tank of claim 1, wherein the stiffening wall divides the hollow interior of the casing into a first chamber and a second chamber, the first chamber in direct fluid communication with a fluid port of the casing and the second chamber in direct fluid communication with the header.

6. The header tank of claim 5, wherein the stiffening wall includes a plurality of flow openings formed therein providing fluid communication between the first chamber and the second chamber.

7. The header tank of claim 6, wherein each of the plurality of flow openings is spaced apart in a longitudinal direction of the header.

8. The header tank of claim 1, wherein a peripheral portion of the header is coupled to a peripheral portion of the frame structure.

9. The header tank of claim 8, wherein the peripheral portion of the header is formed by an outwardly extending rim of the header, the outwardly extending rim including a concave surface corresponding in shape to a convex surface of the peripheral portion of the frame structure.

10. The header tank of claim 1, wherein the frame structure forms a trough around a perimeter of the stiffening element, the trough configured to receive the foot of the casing.

11. The header tank of claim 1, wherein the stiffening element is coupled to the foot of the casing.

12. The header tank of claim 11, wherein at least a portion of the stiffening wall is spaced further from the first plane of the header than any portion of the foot of the casing in the first direction.

13. The header tank of claim 12, wherein the at least a portion of the stiffening wall is spaced twice as far from the first plane of the header than any portion of the foot of the casing in the first direction.

14. The header tank of claim 1, wherein a crimp strip extends from the frame structure around the foot to engage the crimp structure, and wherein the crimp strip is deformed to conform to a shape of the crimp structure.

15. The header tank of claim 14, wherein the crimp strip being deformed to conform to the shape of the crimp structure includes the crimp strip curving around an axis arranged transverse to the first plane of the header.

16. A heat exchanger comprising:

a first header tank including a first casing having a hollow interior and a first header assembly coupled to the first casing, the first header assembly comprising a first header having a plurality of first tube openings formed therein with each of the first tube openings disposed on a first plane of the first header and a first stiffening element coupled to the first header, the first stiffening element including a first stiffening wall extending from a first longitudinal side of the first header to an opposing second longitudinal side of the first header;

a second header tank arranged opposite the first header tank; and a plurality of heat exchanger tubes extending longitudinally between the first header tank and the second header tank with one of the heat exchanger tubes received in each of the first tube openings formed in the first header of the first header tank, wherein the first casing includes an outwardly flanged foot extending around a perimeter of a header opening formed in the first casing and a crimp structure disposed on and projecting away from a surface of the foot arranged parallel to the first plane of the first header, the crimp structure having a shoulder spaced from the surface of the foot, and wherein at least a portion of the stiffening wall is spaced further from the first plane of the first header than the shoulder of the crimp structure with respect to a longitudinal direction of each of the heat exchanger tubes.

17. The heat exchanger of claim 16, wherein a concave inner surface of the first stiffening wall faces towards the first header and an oppositely arranged and convex outer surface of the first stiffening wall faces towards an inner surface of the first casing defining the hollow interior thereof.

18. The heat exchanger of claim 16, wherein the first stiffening element includes a plurality of flow openings formed therein providing fluid communication between an inner surface and an outer surface of the first stiffening element.

19. The heat exchanger of claim 16, wherein at least a portion of the first stiffening wall is spaced further from the first plane of the first header than is any portion of the foot of the first casing in the longitudinal direction of each of the heat exchanger tubes.

20. The heat exchanger of claim 16, wherein the second header tank includes a second casing having a hollow interior and a second header assembly coupled to the second casing, the second header assembly comprising a second header having a plurality of second tube openings formed therein and a second stiffening element coupled to the second header, the second stiffening element including a second stiffening wall extending from a first longitudinal side of the second header to an opposing second longitudinal side of the second header, wherein one of the heat exchanger tubes received in each of the second tube openings formed in the second header of the second header tank.

* * * * *